United States Patent [19]

Hawkins

[11] Patent Number: 4,977,716

[45] Date of Patent: Dec. 18, 1990

[54] GLAZING BARS AND GLAZING ASSEMBLIES

[75] Inventor: Glynn J. Hawkins, Kempsey, England

[73] Assignee: Hempsted Glazing Systems Ltd., Tewkesbury, England

[21] Appl. No.: 392,375

[22] Filed: Aug. 10, 1989

[30] Foreign Application Priority Data

Aug. 13, 1988 [GB] United Kingdom ..... 8819333

[51] Int. Cl.[5] ..... E04B 2/88

[52] U.S. Cl. ..... 52/235; 52/302; 52/464

[58] Field of Search ..... 52/235, 209, 302, 303, 52/398, 464, 198

[56] References Cited

U.S. PATENT DOCUMENTS

| | | | |
|---|---|---|---|
| 3,916,589 | 11/1975 | Richter | 52/464 X |
| 4,055,923 | 11/1977 | Biebuyck | 52/302 X |
| 4,638,613 | 1/1987 | Tönsmann | 52/235 X |
| 4,683,693 | 8/1987 | Rockar et al. | 52/235 X |

FOREIGN PATENT DOCUMENTS

| | | |
|---|---|---|
| 250411 | 2/1925 | Fed. Rep. of Germany . |
| 2136566 | 2/1973 | Fed. Rep. of Germany . |
| 87160129 | 1/1988 | Fed. Rep. of Germany . |
| 2507648 | 12/1982 | France . |
| 2517730 | 6/1983 | France . |
| 210041 | 6/1924 | United Kingdom . |
| 1416577 | 12/1975 | United Kingdom . |
| 1416578 | 12/1975 | United Kingdom . |
| 2211536 | 7/1989 | United Kingdom . |

*Primary Examiner*—David A. Scherbel
*Assistant Examiner*—Creighton Smith
*Attorney, Agent, or Firm*—Young & Thompson

[57] ABSTRACT

A glazing bar comprises sealing means for sealing against one side of each of two glazing units arranged in end by end relationship in a non-horizontal plane. An internal passage is provided in the glazing bar and this passage communicates with an end of the glazing bar. A condensation trap is provided along one edge of the glazing bar for collecting condensation running down the one side of the, in use, upper glazing unit, and an opening communicates the condensation trap with the internal passage, whereby condensation collected in the trap passes into the internal passage, from where it can drain away. A glazing assembly including such a glazing bar is also disclosed.

11 Claims, 3 Drawing Sheets

GLAZING BARS AND GLAZING ASSEMBLIES

BACKGROUND OF THE INVENTION

This invention relates to glazing bars and glazing assemblies.

So called 'Patent Glazing' and 'Sloping Curtain Walling' are site assembled, drained and ventilated systems of dry or gasket glazing, comprising glazing bars and glazing units formed of glass or other suitable material, and are used principally in non-domestic buildings, such as atria and shopping malls.

These are difficulties in handling very large glazing units and in an endeavour to increase the light transmission and aesthetic appearance of 'Patent Glazing' systems it is known to support two glazing units in end by end relationship between a pair of spaced mullions which are arranged in a vertical or an inclined plane and to join the glazing units together at their adjacent ends.

One known method of joining the two glazing units in end by end relationship is to rest the inner sides of the two glazing unit at adjacent ends against a rigid support and to provide a silicone joint between the ends of the glazing units.

However, any condensation forming on the inner side of the upper of the two glazing units will run down this glazing unit and when it reaches the rigid support it will drip off into the inside of the building.

The invention seeks to mitigate this drawback.

SUMMARY OF THE INVENTION

According to a first aspect of the present invention, there is provided a glazing bar comprising sealing means for sealing against one side of each of two glazing units arranged in end by end relationship in a non-horizontal plane, an internal passage communicating with an end of the glazing bar, a condensation trap along one edge of the glazing bar for collecting condensation running down the one side of an, in use, upper of the two glazing units, and an opening communicating the condensation trap with the internal passage, whereby, in use, condensation collected in the trap passes into the internal passage, from where it can drain away.

In practice, the glazing bar will most probably but not necessarily extend, in user, in a horizontal or substantially horizontal direction.

Preferably, the condensation trap comprises a gutter extending lengthwise along the one edge of the glazing bar, the open side of the gutter being spaced from and facing a plane containing that surface of the sealing means which, in use, seals against the glazing units.

Advantageously, the sealing means comprises two sealing elements extending lengthwise of the glazing bar in spaced parallel relationship, the two sealing elements being for sealing against respective glazing units and the space between the sealing elements communicating with an end of the glazing bar so that any moisture getting into the space between the sealing elements can drain away.

Conveniently, the space between the sealing elements is separated from the internal passage. In this case a separating wall between the space and the internal passage can serve to support a spacer block provided, in use, between the adjacent ends of the glazing units.

The glazing bar may be extruded, such as in aluminium, and the sealing means may be of elastomeric material.

According to a second aspect of the invention, there is provided a glazing assembly comprising two spaced apart elongate support members arranged in a vertical or inclined plane, first and second glazing bars secured to or forming part of the two support members, respectively, each of the first and second glazing bars extending lengthwise of respective support members, and having elongate sealing means for sealing against an edge of a glazing unit and an internal drainage channel, a third glazing bar formed according to the first aspect of the invention, and extending transversely between the first and second glazing bars, the internal passage of the third glazing bar communicating with the internal drainage channel of at least one of the first and second glazing bars, two glazing units arranged in end by end relationship, the glazing units being supported along a pair of opposite edges on the sealing means of the first and second glazing bars and at adjacent ends on the sealing means of the third glazing bar, means securing the glazing units to the first and second glazing bars, and sealing material providing a seal between the adjacent ends of the glazing units.

Preferably, the sealing material is a silicone sealant.

Advantageously, a spacer block is provided between the adjacent ends of the glazing units.

Preferably, each of the first and second glazing bars is of generally T-shaped cross section and has two elongate sealing means extending lengthwise along a cross portio of the T-shape on opposite sides, respectively, of a stem portion of the T-shape.

The invention will now be more particularly described, by way of example only, with reference to the accompanying drawings.

DESCRIPTION OF THE PREFERRED EMBODIMENT

Figure 1:
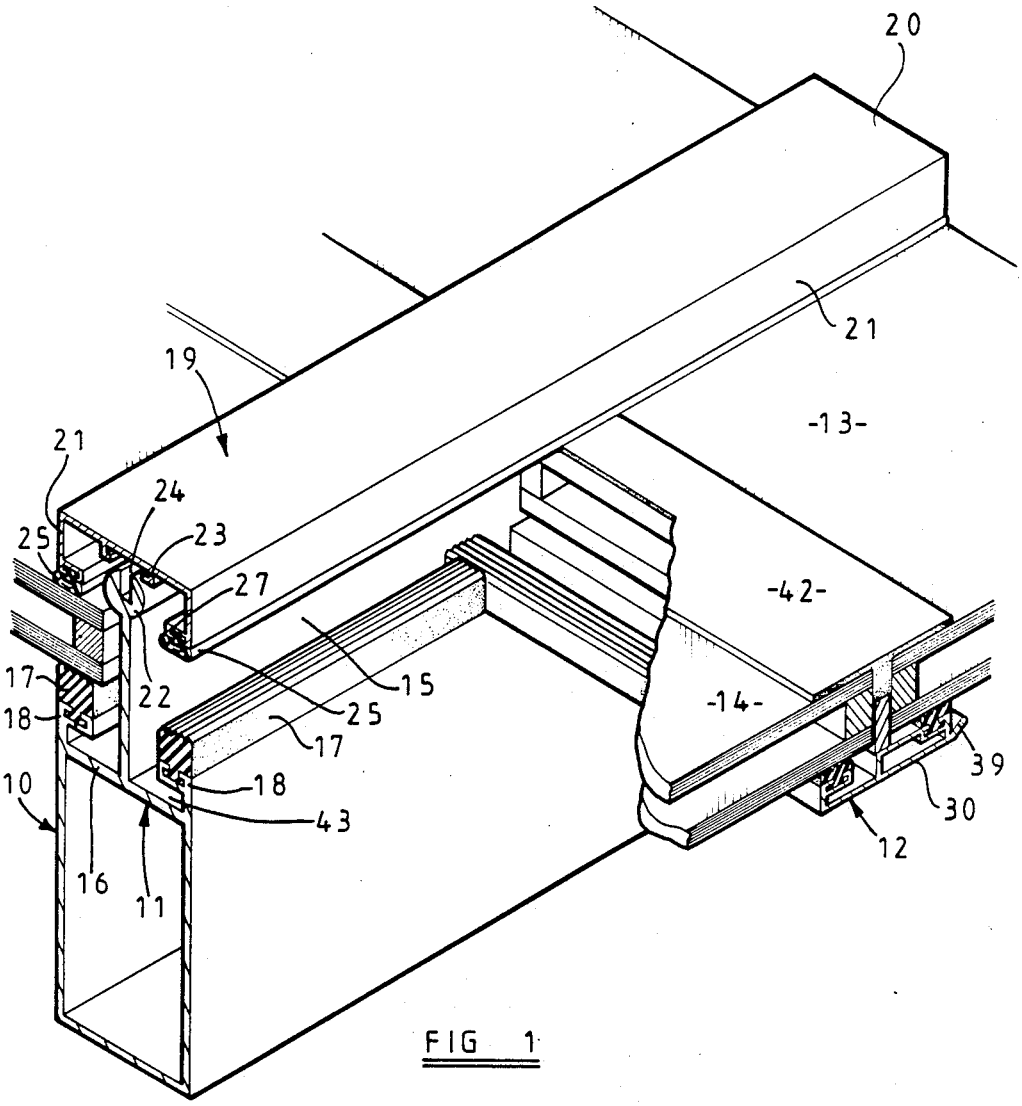
FIG. 1 is a fragmentary, perspective view from a lower end and above a glazing assembly incorporating one embodiment of a glazing bar according to the first aspect of the invention.

Referring now to the drawings, the glazing assembly shown herein forms part of a 'Patent Glazing' system, although it could be adapted to form part of a system of 'Curtain Walling', and comprises an elongate support member in the form of a mullion 10, which includes a glazing bar 11 of generally T-shaped cross-section, a glazing bar 12 in the form of a transom, which extends traversely between two spaced mullions 10, and two glazing units 13 and 14. The mullions are of known general construction and are arranged in an inclined plane to form part of the roof structure of a building, such as an atrium or shopping mall. The mullions may, however, form part of a wall of a building, in which case the mullions may be arranged in a vertical plane.

Briefly, the glazing bar 11, which forms part of each mullion, but which may instead by attached to the mullion, has a central stem portion 15 and a cross portion 16. Sealing elements 17 are fitted in respective formations 18 provided on opposite sides of the stem portion 15 along the two edges of the cross portion 16. The glazing units 13 and 14 which, in the example shown, are sealed double glazing units, are arranged in end by end relationship and are supported along opposite edges on the sealing elements 17 of the glazing bars 11 of two spaced mullions 10. A channel-shaped, elongate cap 19 has a web portion 20 and two side flanges 21 and is clipped to a formation 22 at the free end of the stem portion 15 by clips (not shown) which are located in a channel 23 in the cap 19. The cap 19 can be firmly secured to the glazing bar 11 by self-tapping screws (not shown) which pass through the web portion 20 to engage with serrated edges of a groove 24 in the formation 22. Two sealing elements 25 are fitted in respective formations 27 provided at the free edges of the flanges 21 and the sealing elements 25 bear against the outer side of glazing units 13 and 14 in confronting relationship with respective sealing elements 17.

The glazing bar 12 extends between two mullions 10 and support the adjacent ends of the glazing units 13 and 14 from below. The glazing bar 12, as shown, extends horizontally and at right angles to each mullion 10. However, the glazing bar 12 could extend between the mullions at other angles.

The glazing bar 12 is of channel-shaped cross-section and is, for example, formed as an aluminium extrusion. The glazing bar 12 comprises a web portion 30 and two flanges 31 and 32. Formations 33 are provided at then free edges of the flanges 31 and 32 and elastomeric sealing elements 34 are fitted to the formations 33. An angled wall 35 joins the formation 33 at the free edge of the flange 31 with the web portion 30 and defines within the glazing bar 12 a drainage passage 36 which communicates with at least one, and preferably both ends of the glazing bar 12. The wall 35 also serves to support a spacer block 37 interposed between the adjacent ends of the glazing units 13 and 14.

There is a space 38 between the sealing elements 34. This space 38 communicates with both ends of the glazing bar 12, but is separated from the drainage passage 36 by the wall 35.

The glazing bar 12 has a condensation trap 39 along the uppermost of its two edges. The trap 39 is in the form of a gutter which extends the entire length of the glazing bar 12 and is defined between the flange 31 and an elongate lip 40.

Figure 2:
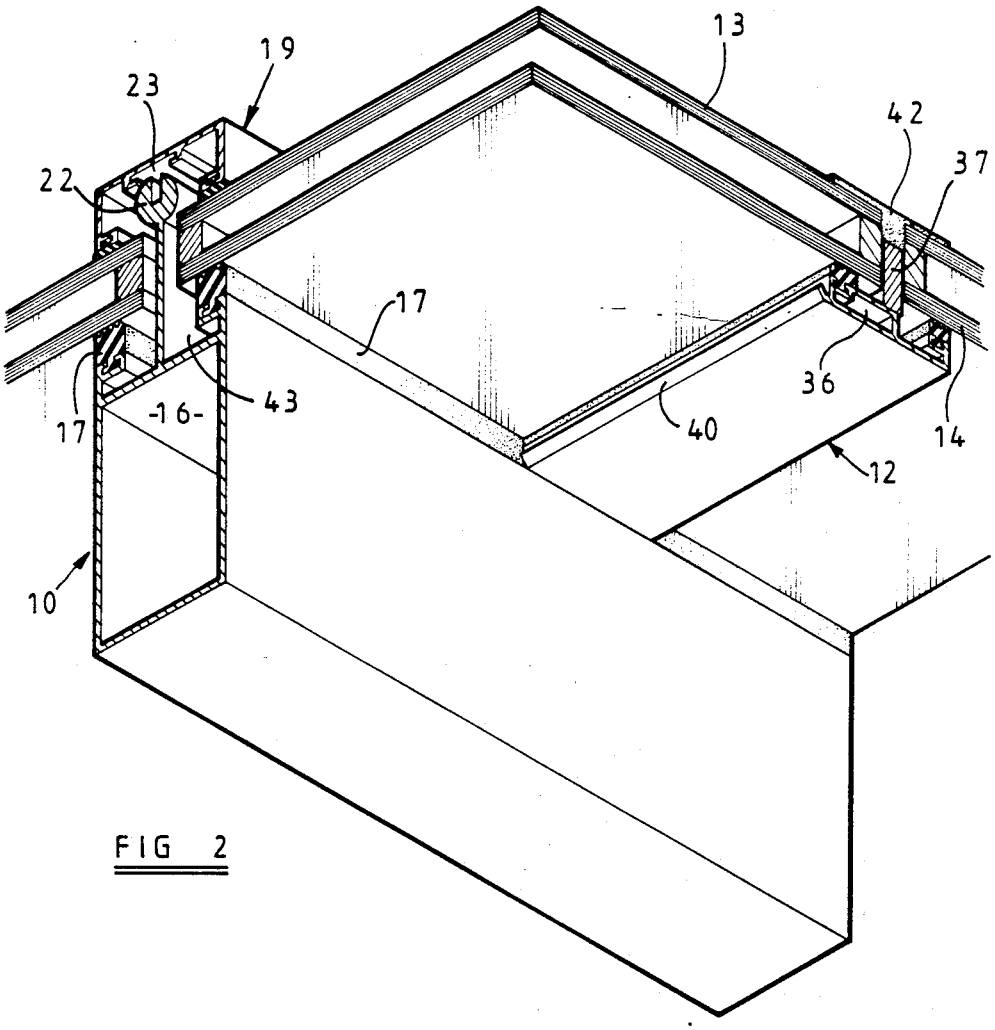
FIG. 2 is a fragmentary, perspective view taken from an upper end and below of the glazing assembly shown in FIG. 1.
Figure 3:
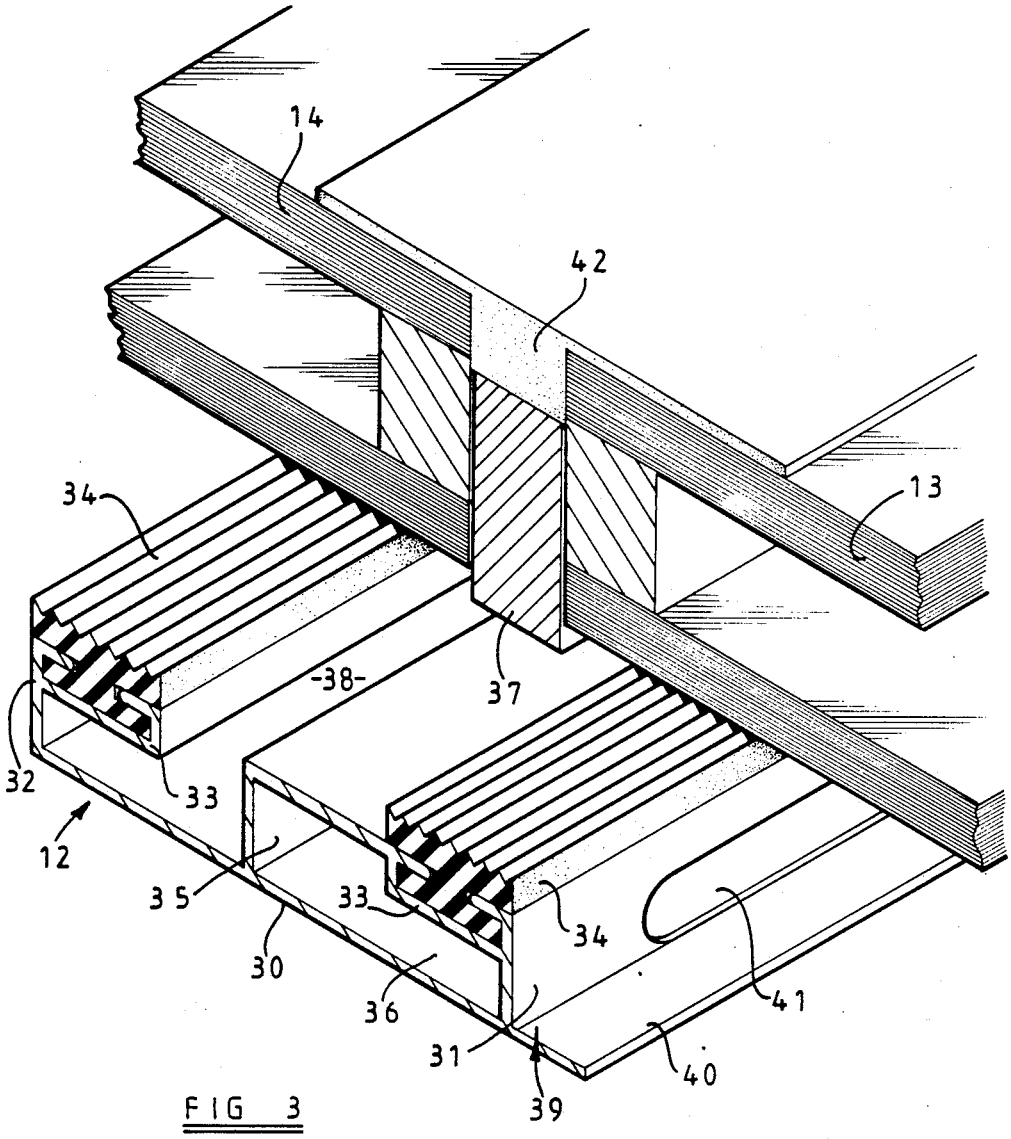
FIG. 3 is a perspective view showing a glazing bar and glazing units of the assembly shown in FIGS. 1 and 2, on an enlarged scale.

At least one and preferably a plurality of spaced openings 41 are provided in the flange 31 so as to communicate the trap 39 with the drainage passage 36. The openings 41 are preferably elongate having their major axes aligned with the longitudinal extend of the flange 31. One such opening 41 is shown in FIG. 3 and in order that the opening 41 may be seen clearly, the lip 40 is shown in FIG. 3 in the plane of the web portion 30, whereas in practice the lip 40 extends towards a plane containing the sealing elements 34, as shown in FIGS. 1 and 2.

The glazing bar 12 is supported on formations 18 of two glazing bars 11 and in a break in the sealing elements 17. A butyl sealant may be provided between the glazing bar 12 and each glazing bar 11 to provide a watertight joint. A joint 42 is made between the adjacent ends of the glazing units 13 and 14 by silicone sealing material which enters the space between the glazing units 13 and 14 above the spacer block 37 and which overlies the adjacent outer edge portions of the glazing units 13 and 14.

Any condensation forming on the inner side of the upper glazing unit 13 will run down the glazing unit 13 and when it reaches the glazing bar 12, instead of dripping off the glazing bar 12, will be collected in the condensation trap 39. Condensation collected in the trap 39 will pass through the opening 41 into the drainage passage 36 from where it will drain away through drainage channels 43 within the glazing bars 11.

Moreover, should any moisture penetrate the joint 42, the moisture will pass into the space 38 between the sealing elements 34 and drain away through the drainage channels 43 within the glazing bars 11.

The above embodiment is given by way of example only and various modifications will be apparent to persons skilled in the art without departing from the scope of the present invention.

What is claimed is:

1. A glazing bar comprising sealing means for sealing against one side of each of two glazing units arranged in end by end relationship in a non-horizontal plane, an internal passage communicating with an end of the glazing bar, a condensation trap along one edge of the glazing bar for collecting condensation running down the one side of an, in use, upper of the two glazing units, and an opening communicating the condensation trap with the internal passage whereby, in use, condensation collected in the trap passes into the internal passage, from where it can drain away, the condensation trap comprising a gutter extending lengthwise along the one edge of the glazing bar, the gutter having an open side which is spaced from and which faces a plane containing that surface of the sealing means which, in use, seals against the glazing units.

2. A glazing bar as claimed in claim 1, wherein the sealing means comprises two sealing elements extending lengthwise of the glazing bar in spaced relationship, the two sealing elements being for sealing against respective glazing units and the sealing elements having a space therebetween which communicates with an end of the glazing bar so that any moisture getting into the space between the sealing elements can drain away.

3. A glazing bar as claimed in claim 1, in the form of an extrusion.

4. A glazing bar as claimed in claim 1, wherein the sealing means is of elastomeric material.

5. A glazing assembly comprising two spaced apart elongate support members arranged in a non-horizontal plane; first and second glazing bars secured to or forming part of the two support members, respectively, each of the first and second glazing bars extending lengthwise of respective support members, and having elongate sealing means for sealing against an edge of a glazing unit, and an internal drainage channel; a third glazing bar extending transversely between the first and second glazing bars and comprising sealing means for sealing against one side of each of two glazing units, an internal passage communicating with the internal drainage channel of at least one of the first and second glazing bars, a condensation trap along one edge of the third glazing bar, and an opening communicating the condensation trap with the internal passage; two glazing units arranged in end by end relationship, the glazing units being supported along a pair of opposite edges thereof on the sealing means of the first and second glazing bars and at adjacent ends on the sealing means of the third glazing bar; means securing the glazing units to the first and second glazing bars; and sealing material providing a seal between the adjacent ends of the glazing units.

6. A glazing assembly as claimed in claim 5, wherein the sealing material is a silicone sealant.

7. A glazing assembly as claimed in claim 5, wherein a spacer block is provided between the adjacent ends of the glazing units.

8. A glazing assembly as claimed in claim 5, wherein each of the first and second glazing bars is of generally T-shaped cross-section and has two elongate sealing means extending lengthwise along a cross portion of the T-shape on opposite sides, respectively, of a stem portion of the T-shape.

9. A glazing bar comprising sealing means for sealing against one side of each of two glazing units arranged in end by end relationship in a non-horizontal plane, an internal passage communicating with an end of the glazing bar, a condensation trap along one edge of the glazing bar for collecting condensation running down the one side of an, in use, upper of the two glazing units and an opening communicating the condensation trap with the internal passage, whereby, in use, condensation collected in the trap passes into the internal passage, from where it can drain away, wherein the sealing means comprises two sealing elements extending length wise of the glazing bar in spaced relationship, the two sealing elements being for sealing against respective glazing units and the sealing elements having a space therebetween, wherein the space between the sealing elements is separated from the internal passage.

10. A glazing bar as claimed in claim 9, wherein a separating wall between the space and the internal passage can serve to support a spacer block provided, in use, between the adjacent ends of the glazing units.

11. A glazing bar comprising sealing means for sealing against one side of each of two glazing units arranged in end by end relationship in a non-horizontal plane, an internal passage communicating with an end of the glazing bar, a condensation trap along one edge of the glazing bar for collecting condensation running down the one side of an, in use, upper of the two glazing units, and an opening communicating the condensation trap with the internal passage, whereby, in use, condensation collected in the trap passes into the internal passage, from where it can drain away, the condensation trap comprising a gutter and said opening and said internal passage being disposed side by side in a direction parallel to a plane containing that surface of the sealing means which, in use, seals against the glazing units.

* * * * *